US005216985A

United States Patent [19]

Brümmer et al.

[11] Patent Number: 5,216,985

[45] Date of Patent: Jun. 8, 1993

[54] INTAKE MANIFOLD HAVING AN ELASTICALLY EXPANDABLE MEMBRANE

[75] Inventors: Michael Brümmer, Laudenbach; Detlef Cordts, Mörlenbach; Bernhard Gesenhues, Birkenau, all of Fed. Rep. of Germany

[73] Assignee: Firma Carl Freudenberg, Weinheim/Bergstr., Fed. Rep. of Germany

[21] Appl. No.: 934,132

[22] Filed: Aug. 24, 1992

[30] Foreign Application Priority Data

Oct. 25, 1991 [DE] Fed. Rep. of Germany ..... 4135271

[51] Int. Cl.[5] ..... F02M 35/10

[52] U.S. Cl. ..... 123/52 MC

[58] Field of Search ..... 123/52 M, 52 MB, 52 MC, 123/52 MV, 52 MF

[56] References Cited

U.S. PATENT DOCUMENTS

| | | | |
|---|---|---|---|
| 3,875,918 | 4/1975 | Loynd | 123/52 M |
| 4,928,638 | 5/1990 | Overbeck | 123/52 M |

FOREIGN PATENT DOCUMENTS

| | | | |
|---|---|---|---|
| 3630488 | 3/1987 | Fed. Rep. of Germany . | |
| 0013768 | 1/1987 | Japan | 123/52 M |
| 0018134 | 1/1988 | Japan | 123/52 M |

*Primary Examiner*—David A. Okonsky

*Attorney, Agent, or Firm*—Kenyon & Kenyon

[57] ABSTRACT

An intake manifold for an internal combustion engine is disclosed. The intake manifold has an intake manifold body of fixed cross-section with a passage passing through it. The passage area can be altered by an expansible member arranged in the passage. The expansible member is an elastically expandable membrane, as well as a supply pipe used to expand the membrane, as needed, by use of a fluid medium.

7 Claims, 4 Drawing Sheets

FIG. 4.1
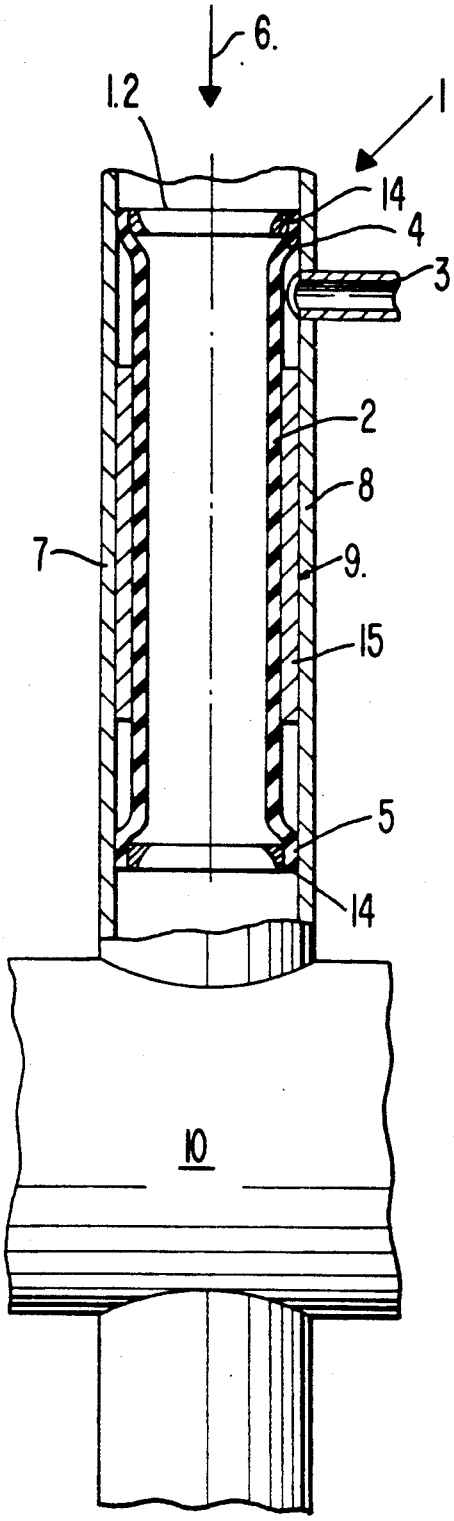
FIG. 4.2
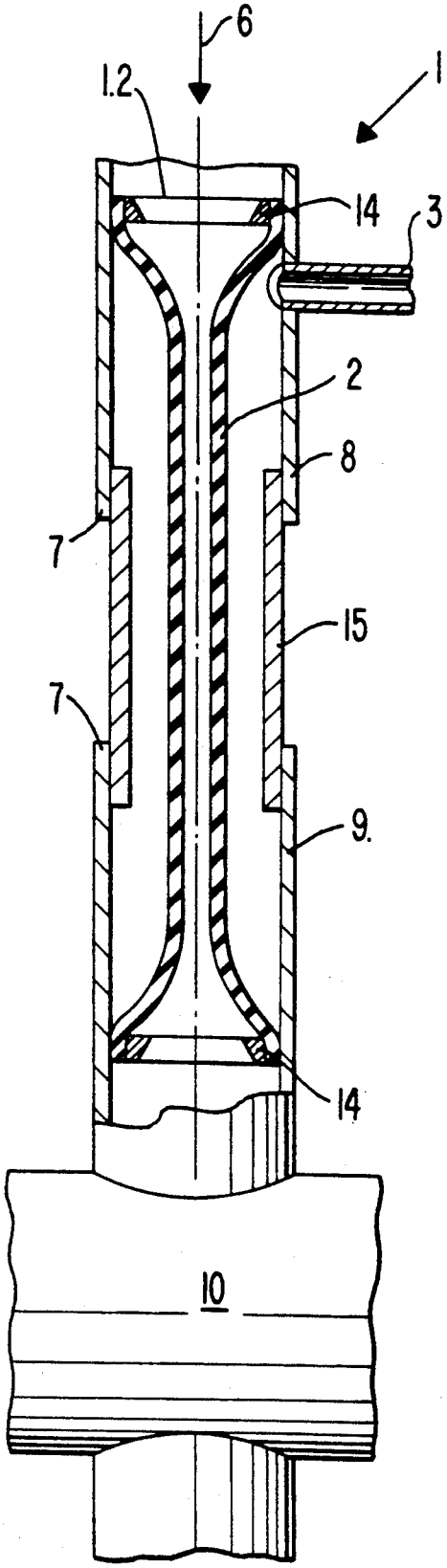

INTAKE MANIFOLD HAVING AN ELASTICALLY EXPANDABLE MEMBRANE

The invention relates to an intake manifold for an internal combustion engine. The intake manifold has an rigid exterior body having one opening, which is used to feed pressurized fluid to an expandable element which regulates the size of the fuel passage. The intake manifold therefore allows regulation of the fuel flow using a simple and easy to control system.

Within the scope of the present invention, the intake manifold is understood to be the part situated between a throttle device, for instance a throttle valve or a rotary slide valve, and the internal combustion engine. Intake manifolds for internal combustion engines are generally known. It is worth noting, however, that in known intake manifolds, which use a body with a fixed cross-section, ideal values for the degree of fuel flow into the internal combustion engine, efficiency, and fuel consumption can only attained within a very narrow speed range.

Intake manifolds for internal combustion engines which are variable in length are disclosed in German Published Patent Application 36 30 488. The intake manifold consists of three pipes which telescope within one another so that the length of the manifold can be altered, in thrombone-like fashion, in dependence upon rotational speed.

The object of the present invention is to develop an intake manifold that results in reduced fuel consumption and an improved degree of fuel flow regulation to the internal combustion engine, and that enables these advantages to be utilized over a broad range of rotational speeds. Furthermore, the intake manifold should exhibit a smaller length, particularly in the longitudinal direction, compared to intake manifolds which only vary in length. The intake manifold should also exhibit a greater functional reliability over a long service life.

In the intake manifold of the present invention, means for altering the passage area are arranged in the opening. The velocity and the rate of oscillation of the fuel flow into the internal combustion engine can be influenced by altering the passage area. Altering the passage area in dependence upon the engine speed guarantees that the fuel usage is optimized over a very broad speed range. A higher degree of admission is also guaranteed for the internal combustion engine because of the recharging or scavenging effect attained as the result of selectively influencing the gas vibrations. Compared to previous known intake manifolds, modification of the passage area in the present invention does not require larger dimensions.

In the intake manifold of variable cross-section of the present invention, the means for altering the passage area consist of a flexibly expandable expansion member and a supply pipe for expanding the expansion member with a fluid medium. It is advantageous if little resistance opposes the flowing medium when the cross-section of the opening is to be modified. This produces a flow with very little turbulence and provides for excellent filling of the combustion chambers of the connected internal combustion engine.

An advantageous refinement is for the expansion member to have an annular shape and to concentrically surround the opening. This configuration of the expansion member relative to the opening results in a particularly uniform alteration of the passage area of the opening when the expansion member is pressurized or subjected to a partial vacuum. The expansion member can be constructed of many different kinds of elastomeric materials and also can have reinforcements to guarantee specific deformation properties when pressurized.

The expansion member can be reinforced in at least one subsection by wires of metallic material, which are not interconnected. These wires can be arranged in the direction of flow.

The expansion member can be designed so that it only elastically deforms in the subsection surrounding the opening. In this subsection the expansion member can consist of a tube. The anchor zones of the component parts, which are interconnected to be gas- and liquid-tight, show a clearance from one another in the direction of flow. In this embodiment, the expansion member can be deformed in its elastic subsection and, as a result, can alter the passage area of the opening. Depending upon the construction of the elastic member this can take place, for example, by pressurizing the elastic area from the outside in the radial direction toward the inside, through which means the opening through the intake manifold can be sealed either steplessly or in a fixed cycle. According to another embodiment, the elastically deformable subsection can be formed by a component part, which is at least partially reinforced by fibers, and which substantially seals off the opening through the intake manifold without pressurization. By applying a partial vacuum to the elastic expansion member through the supply pipe, the elastically deformable subsection moves in the radial direction outwardly and positions itself against the intake manifold body. The opening through the intake manifold at that point exhibits is largest cross-section.

To achieve a swing-pipe recharging which is even more precisely adjusted to the specific conditions of the internal combustion engine, the intake manifold body can be separated between the anchor zones at right angles to the direction of flow. The sections produced by the separation can move relative to one another in the direction of flow and are sealed off from one another. In this embodiment, further improved charging of the combustion chambers of the attached internal combustion engine results in dependence upon the prevailing operating speed of the internal combustion engine. Moreover, according to this embodiment, the swing-pipe recharging produces a high and more uniform torque over a large speed range with low fuel consumption, low emission of pollutants, and good working properties over a long service life. As already mentioned, for these results it is necessary to lengthen the intake manifold in the lower speed range relative to an average neutral position, while the length of the intake manifold in the upper speed range must be reduced. This change can be made with a comparatively small passage area in the lower speed range, for example up to 4,000 rpm, and with a steplessly enlarged passage area in the upper speed range. As a result of the combination of variable intake manifold length and passage area, excellent results can be attained with respect to high motor output, high torque, and low fuel consumption. The changes in length of the movable parts can be accomplished by means of a motor actuator, which is connected through signal transmission to the motor control of the motor vehicle.

The fluid medium for expanding the expansion member can consist of a liquid. The intake manifold with its variable cross-section has particularly advantageous performance when a liquid silicon is used. It is desirable that at high fuel flow velocities through the intake manifold, no changes in the form of the elastic subsections, particularly of the intake area, result so that the properties which are very beneficial to the flow are retained.

Gases, liquid, or gel-like media, for example, can be used to expand the expansion member. These media can also be used, for example, as fillers for open-pored foam, which is subsequently used to expand the expansion member.

The subject matter of the present invention shall be clarified in greater detail on the basis of the enclosed drawings. They depict a few exemplified embodiments in a schematic representation:

Figure 1:
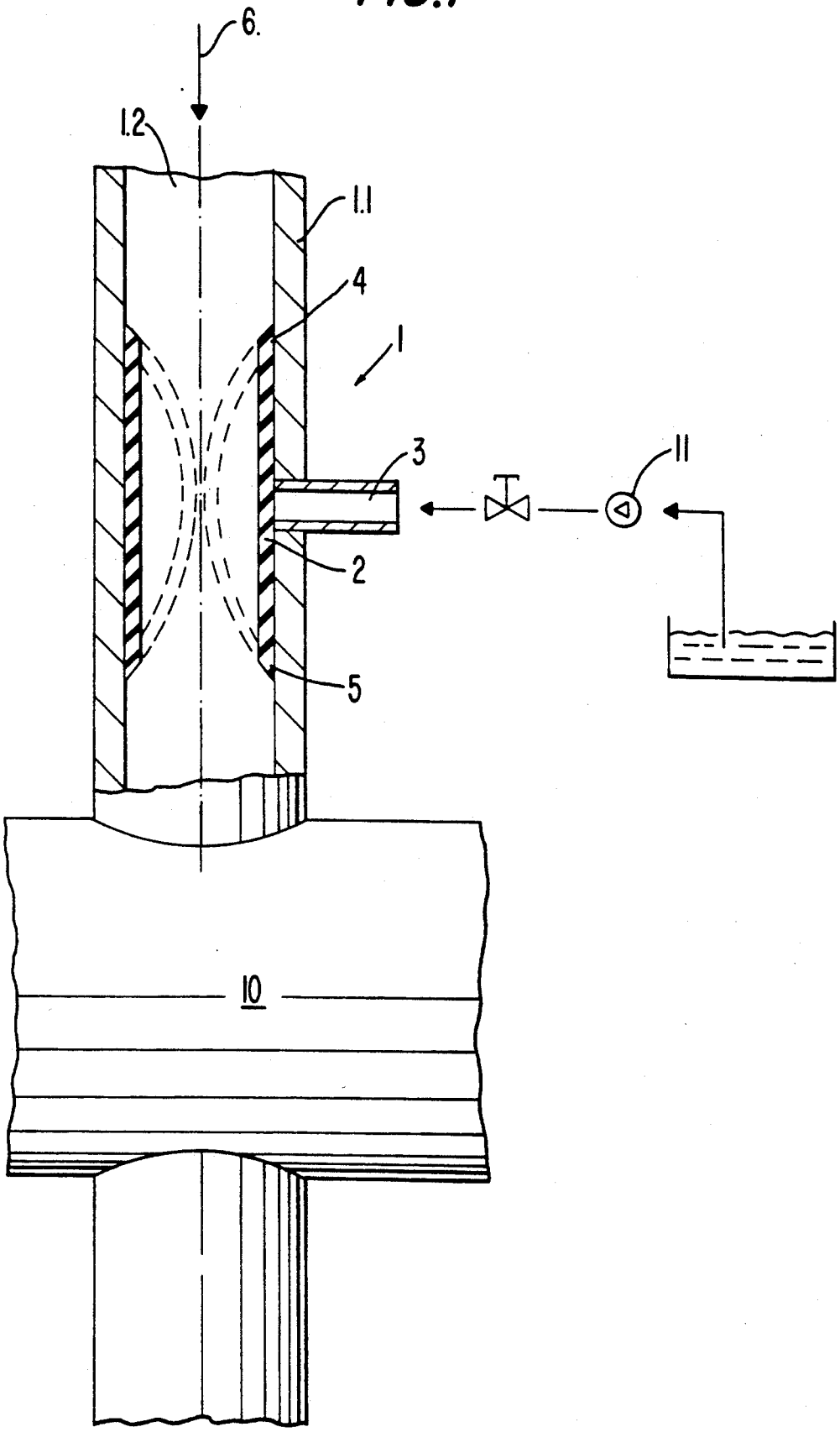
FIG. 1 shows a first embodiment of the present invention.

FIG. 4.1 shows a third embodiment of the present invention in an unlengthened and widened state.

FIG. 4.2 shows the third embodiment of the present invention in a lengthened and narrowed state.

FIGS. 1, 2, 3, and 4 each depict an intake manifold 1 of a variable cross-section for an internal combustion engine 10. The manifold comprises an inherently stable intake manifold body 1.1 having an opening 1.2. In the present invention, the variable cross-section intake manifold is understood to be only the part configured between a throttle device (not shown), for instance a throttle valve, and the internal combustion engine 10. A mechanism for altering the passage area is arranged in the opening 1.2. This mechanism consists of an elastically expandable expansion member 2. A fluid medium for expanding the expansion member 2 is supplied to this member via a supply pipe 3. The expansion member 2 is expanded or contracted as the result of pressurization or the application of a partial vacuum to the fluid medium. However, the expansion member 2 could be constructed so that it clears an average passage area through the opening 1.2, without being pressurized from the outside. When the internal combustion engine is in the low speed range, the expansion member could then be pressurized to restrict flow, and in the upper speed range a partial vacuum could be applied. The result would be that favorable passage cross-sections would be obtained to allow a good degree of admission of fuel and as a result, low fuel consumption.

A simple exemplified embodiment of the invention is schematically depicted in FIG. 1. The supply pipe 3 is arranged in a gas- and liquid-tight manner in an opening of the intake manifold body 1.1 of the intake manifold 1. To alter the passage cross-section of the opening 1.2, a fluid medium is delivered by a pump 11 through the supply pipe 3 and into the expansion member 2. Depending on the operating state of the internal combustion engine, the elastic expansion member 2 produces a larger or smaller cross-section in the opening 1.2. The volume of fluid medium output through the pump 11 into the expansion member 2 can be controlled by an engine characteristics map, which can be integrated in the electronic motor control for the internal combustion engine. The elastically expandable expansion member 2 is affixed in a gas- and liquid-tight manner at its anchor zones 4, 5 to the inside wall of the intake manifold body 1.1. The full-load state of the internal combustion engine 10 at high rotational speeds is shown in FIG. 1 with full solid lines, while the state at low rotational speeds is depicted with broken lines. Any passage area whatsoever can be produced for an engine condition between a highest rotational speed and idling, by pressurizing the elastically expandable expansion member 2. At the highest rotational speed, when the expansion member 2 clears the largest passage cross-section through the opening 1.2, the expansion member 2 abuts under stress against the inside of the intake manifold body 1.1. Expansion and contraction of the expansion member 2 can follow through the application of pressure as well as through the application of a partial vacuum. In the representation of FIG. 1, it is conceivable for the expansion member 2 to abut without pressurization and under prestress against the inner side of the intake manifold body 1.1. If the expansion member 2 is subsequently pressurized via the supply pipe 3, the expansion member 2 gradually seals off the opening 1.2, as depicted by the broken lines.

Figure 2:
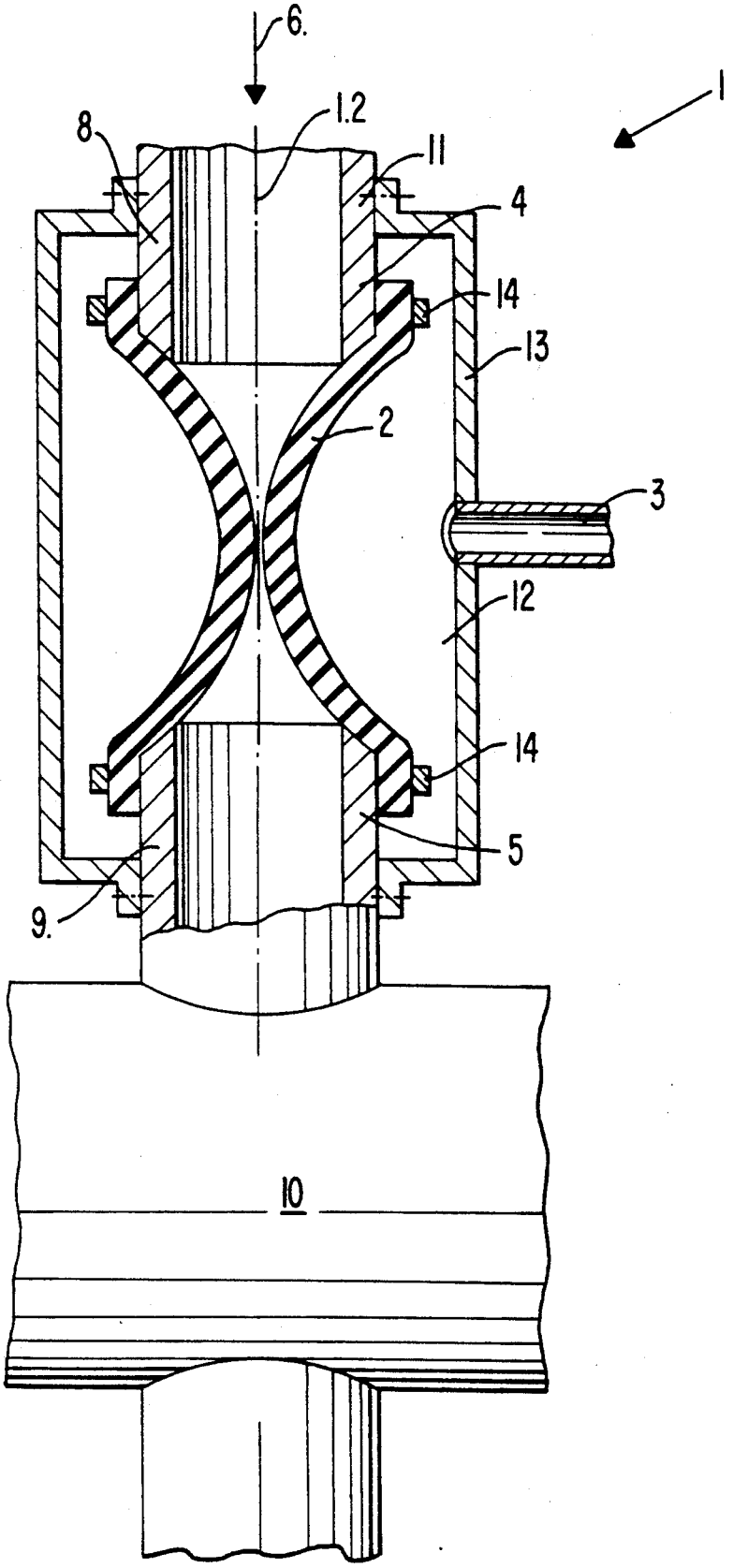
FIG. 2 shows a second embodiment of the present invention, with the elastic member in a narrowed state.
Figure 3:
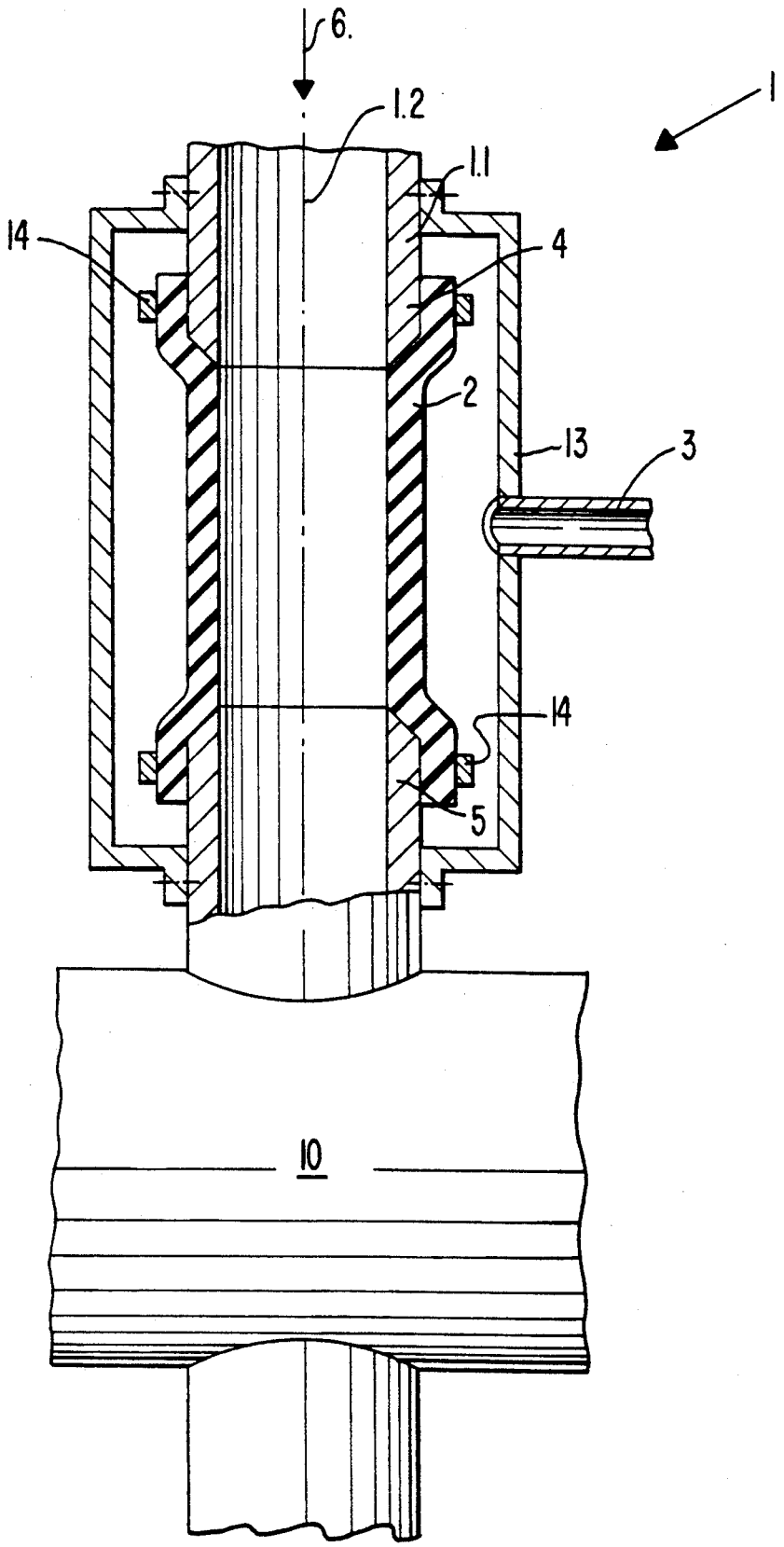
FIG. 3 shows the second embodiment of the present invention, with the elastic member in a widened state.

In FIGS. 2 and 3, the expansion member 2, which consists in this embodiment of a tube, is affixed on the outside of the intake manifold body 1.1. The expansion member 2 forms a part of the intake manifold 1 and is situated in a housing 13, which is provided with a supply pipe 3 and is affixed to the intake manifold body 1.1. The favorable configuration for low rotational speeds is depicted in FIG. 2. The expansion member 2 seals off the opening 1.2 largely because the cavity 12, which is sealed off by the housing 13 in a gas- and liquid-tight manner from the intake manifold 1, is pressurized. The expansion member 2 can be a affixed to the intake manifold body 1.1 by fastening elements 14 in the area of the anchor zones 4,5.

FIG. 3 depicts the intake manifold of FIG. 2 when the connected internal combustion engine 10 is operated in the full-load state at high rotational speeds. Here, there is little or no pressurization from the supply pipe 3. The expansion member 2 assumes the position shown in FIG. 3, for example, as the result of a reinforcement which varies in strength and is made up of directed fibers. A reinforcement consisting of metallic materials could also be used. As shown here, the passage cross-section through the opening 1.2 is at its largest. No turbulence arises in the area of the passage opening 1.2 because the areas consisting of the intake manifold body 1.1 and the expansion member 2 are flush with one another. The fuel flow to the connected internal combustion engine 10 is the greatest in this configuration. The expansion member 2 can also assume the position shown in FIG. 3 when the housing surrounding it is shaped along its inner side to correspond to the radially external contour of the expansion member 2, so that the expansion member 2 is placed against the housing without pressurization or with the application of a partial vacuum.

The representations in FIGS. 2 and 3 can also find application when the pressurization is by means of a partial vacuum. The expansion member will exhibit a shape, as a result of its manufacture, that corresponds to the shape shown in FIG. 2. In this case, pressurization through the supply pipe 3 is not needed. The expansion member 2 is then expanded by application of a partial vacuum through the supply pipe 3. The shape of expansion member 2 depends upon the level of the partial vacuum.

To further improve the operational performance of the internal combustion engine so as to have a lower emission of pollutants, the intake manifold can be designed in accordance with FIG. 4. As shown in FIG. 4.1, the internal combustion engine 10 is operating in a full-load state at high rotational speeds. The multisectional intake pipe 1 shows a minimal length, while the expansion member clears the largest possible area through the opening 1.2 in the flow-through direction 6. The expansion member 2 is affixed in a gas- and fluid-tight manner to the intake manifold body 1.1 in the area of the anchor zones 4, 5. FIG. 4.2 depicts the internal combustion engine in a low rotational-speed state. The intake pipe has been lengthened compared to the representation in FIG. 4.1, and the expansion member 2 has reduced the passage area of the opening 1.2 as the result of pressurization through the supply pipe 3. In FIGS. 4.1 and 4.2, two sections 8, 9 are produced by the separation 7. These sections are designed to be movable relative to one another in the direction of flow 6. The connecting part 15 interconnects the two sections 8 and 9 in the direction of flow and seals off the opening 1.2 and the two sections 8 and 9 from the environment.

To alter the length of the intake manifold, an automatic final controlling device (not shown here) can be provided. In dependence upon the prevailing rotational speed of the internal combustion engine, it adjusts the length of the intake manifold 1 to an advantageous value. The final controlling device can consist, for instance, of a motor actuator (not shown here), which is connected to the engine characteristics map of the motor control of the internal combustion engine 10.

To enlarge the opening 1.2, particularly in the FIG. 4.1 and 4.2 embodiment, the connecting piece 15 could also be arranged radially outside of the intake manifold 1. Such a refinement produces a large passage area for the full-load range of the internal combustion engine 10 and results in improved charging of the combustion chambers. The embodiments depicted in FIGS. 2 and 3 can include a variable intake-manifold length. The length of the intake manifold body 1.1, which is subdivided as the result of the separation 7 into two sections 8, 9, can be varied in the direction of flow 6. The two sections 8, 9 are sealed off from one another, for example, by means of the fastening elements 14 and the expansion member 2. The expansion member 2 is elastically deformed when the length of the intake pipe 1 is altered.

To enable the length to be altered, the intake manifold can be designed to have at least one subsection made of a metal corrugated pipe. The length can be changed by mechanical, hydraulic or pneumatic means. The pressure or partial vacuum required to actuate the change in the cross-section in the intake manifold 1 can be generated by pumps in conjunction with accumulators. The pumps can be operated electrically by the vehicle electrical system.

I claim:

1. An intake manifold for an internal combustion engine comprising:

an intake manifold body of a fixed cross-section, a fuel flow passage through said body, and means for altering the cross-sectional area of said passage, the means for altering comprising an elastically expandable expansion member and a supply pipe for providing a fluid medium to the exterior of said expansion member to expand and contract said expansion member, wherein the expansion member has an annular shape and concentrically surrounds the passage.

2. An intake manifold for an internal combustion engine comprising:

an intake manifold body of a fixed cross-section, a fuel flow passage through said body, and means for altering the cross-sectional area of said passage, the means for altering comprising an elastically expandable expansion member and a supply pipe for providing a fluid medium to the exterior of said expansion member to expand and contract said expansion member, wherein the expansion member is only elastically deformable in a subsection surrounding the passage.

3. The intake manifold of claim 2, wherein:

in the subsection the expansion member comprises a tube, the tube and the intake manifold body being connected in a gas- and liquid-tight manner at anchor zones spaced from one another.

4. The intake manifold of claim 3, wherein:

the intake manifold body is separated at a point between the anchor zones, the separation being situated at right angle to the direction of fuel flow, and wherein the sections produced by the separation can move relative to one another in the direction of fuel flow, and wherein the sections are sealed off from one another.

5. The intake manifold of claim 4, wherein:

the fluid medium comprises a liquid.

6. An intake manifold for an internal combustion engine comprising:

an intake manifold body of a fixed cross-section, a fuel flow passage through said body, and means for altering the cross-sectional area of said passage, the means for altering comprising an elastically expandable expansion member and a supply pipe for providing a fluid medium to the exterior of said expansion member to expand and contract said expansion member, wherein the expansion member completely seals off the passage without pressurization by said fluid medium.

7. The intake manifold of claim 1, wherein:

said intake manifold body is constructed of multiple sections which may move relative to one another to lengthen the fuel flow passage.

* * * * *